United States Patent [19]

Yunoki

[11] Patent Number: 4,524,659

[45] Date of Patent: Jun. 25, 1985

[54] APPARATUS FOR CUTTING CONTINUOUS SLIDE FASTENER CHAIN

[75] Inventor: Akio Yunoki, NE. Marietta, Ga.

[73] Assignee: Yoshida Kogyo K. K., Tokyo, Japan

[21] Appl. No.: 434,933

[22] Filed: Oct. 18, 1982

[30] Foreign Application Priority Data

Oct. 23, 1981 [JP] Japan ..... 56-170420

[51] Int. Cl.[3] ..... B26D 7/06

[52] U.S. Cl. ..... 83/80; 83/156; 83/282; 83/921; 83/210

[58] Field of Search ..... 83/210, 921, 441, 282, 83/80, 156; 29/770, 408; 226/190, 192

[56] References Cited

U.S. PATENT DOCUMENTS

| | | | |
|---|---|---|---|
| 2,754,908 | 7/1956 | Proud | 164/49 |
| 3,730,411 | 5/1973 | Brockmuller | 83/175 |
| 3,776,078 | 12/1973 | Perlman | 83/921 |
| 3,872,571 | 3/1975 | Douri | 29/408 |
| 3,886,828 | 6/1975 | Müller | 83/156 |
| 3,902,954 | 9/1975 | Lotto | 83/156 |
| 4,262,569 | 4/1981 | Yoshieda | 83/282 |
| 4,307,500 | 12/1981 | Kuse | 83/921 |
| 4,366,736 | 1/1983 | Oosaki | 83/921 |

*Primary Examiner*—James M. Meister
*Assistant Examiner*—John L. Knoble
*Attorney, Agent, or Firm*—Hill, Van Santen, Steadman & Simpson

[57] ABSTRACT

An apparatus for cutting off lengths of slide fasteners from a continuous chain thereof includes a cutting punch coactive with an anvil, there being feed rolls disposed in the path of movement of the fastener chain upstream from the cutting punch, and a pair of delivery rolls in such path downstream of the cutting punch. The upper delivery roll is arranged to reciprocate with the cutting punch and to engage the chain before the cutting punch does, and to continue to engage the chain until the cutting punch has been slightly retracted. Such retraction of the delivery roll facilitates feeding of the chain even though the leading end may be slightly curled.

3 Claims, 8 Drawing Figures

APPARATUS FOR CUTTING CONTINUOUS SLIDE FASTENER CHAIN

BACKGROUND OF THE INVENTION

1. Field of the Invention

This invention relates to an apparatus for cutting a continuous slide fastener chain into individual fastener product lengths.

In the manufacture of slide fasteners, it is the customary practice to make a continuous chain of a pair of so-called "stringers" each comprising of a support tape carrying along a beaded edge thereof a row of coupling fastener elements, to provide element-free gaps at predetermined intervals in and along the beaded edges of the tape, and to cut the fastener chain into individual fastener lengths at the gaps, thereby providing tape ends which are devoid of coupling elements for attachment thereon of fastener parts such as sliders and end stops to complete the formation of commercial product fasteners.

2. Prior Art

In the art of cutting a slide fastener chain into individual product lengths to which the present invention relates, to this end there have been proposed various machines, a typical example of which is disclosed in U.S. Pat. No. 2,754,908. This patent shows a machine comprising a vertically movable cutter and an anvil cooperating therewith to cut the fastener chain as desired, a pair of feed rolls disposed forwardly of the cutter and a pair of delivery rolls disposed rearwardly of the cutter. One of the feed rolls is a driven roll and the other is a follower roll normally resting on the driven roll; the driven and follower rolls coact to feed the fastener chain. Likewise, one of the delivery rolls is a driven roll and the other is a follower roll normally resting on the driven roll; the driven and follower rolls coact to deliver the cut length of the fastener chain. While this prior art machine is satisfactory in respect of delivering the cut length of chain out of the machine, there is encountered a problem in the feeding of an un-cut chain end from the feed-roll side to the delivery-roll side where the tape end is curled or rolled, which is usually the case with fastener chains taken up and stored on a reel. The reeled fastener chain tends to maintain its curled posture even after it is unreeled; the chain with the curled end raised advances and it is hence difficult for it to enter into and through the pair of delivery rolls forwardly of the cutter and it is therefore prone to move away, off the guideway of the machine.

SUMMARY OF THE INVENTION

It is a primary object of the present invention to provide an improved apparatus which incorporates structural and functional features such that an unobstructed space is temporarily provided on the traveling path of a fastener chain while the uncut end of the chain is fed to the delivery rolls, thus allowing the uncut end of the chain to be guided properly along the guideway to the delivery rolls, even though the uncut end of the chain is curled and thus raised as the chain advances.

It is another object of the present invention to provide an improved apparatus for cutting a continuous slide fastener chain into individual fastener product lengths which is relatively simple in construction and effective and efficient in operation.

Briefly stated, in the apparatus according to the invention, there is provided a pair of vertically disposed delivery rolls forwardly of a punch and die for delivering a cut length of a fastener chain out of the apparatus, the upper one of said rolls being timed in movement with a cutting punch in such a manner that the upper roll ascends after the punch and descends in advance of the punch.

The above objects and features of the present invention will be better understood from the following description taken in connection with the accompanying drawings which illustrate by way of example a preferred embodiment.

DETAILED DESCRIPTION OF THE PREFERRED EMBODIMENT

Figure 8:
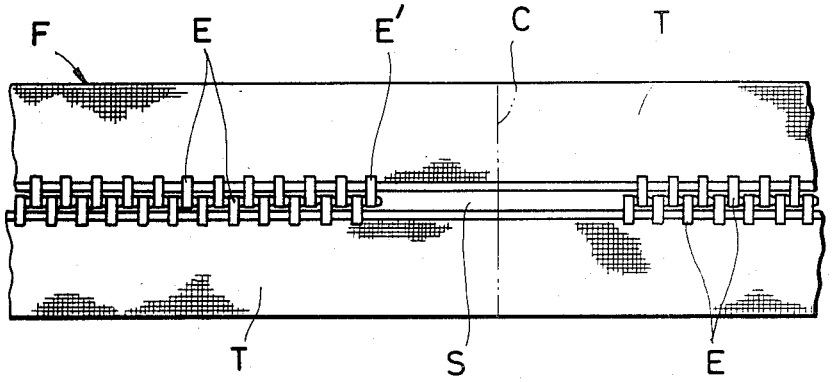
FIG. 8 is a plan view of a segment of a slide fastener chain to be cut.

In FIG. 8, there is shown a segmental portion of a slide fastener chain F which comprises a pair of support tapes T carrying along their longitudinal inner edges respective rows of coupling elements E which are coupled and uncoupled in a well known manner by a slider (not shown) to close and open the fastener. The fastener chain F has a plurality of element-free portions S spaced longitudinally at regular distances corresponding to a predetermined slide fastener length, each element-free portion S being devoid of a group of the coupling elements E. The fastener chain F is to be cut into a slide fastener length along a prospective cut line C extending transversely across the tape T at the element-free portion S.

Figure 1:
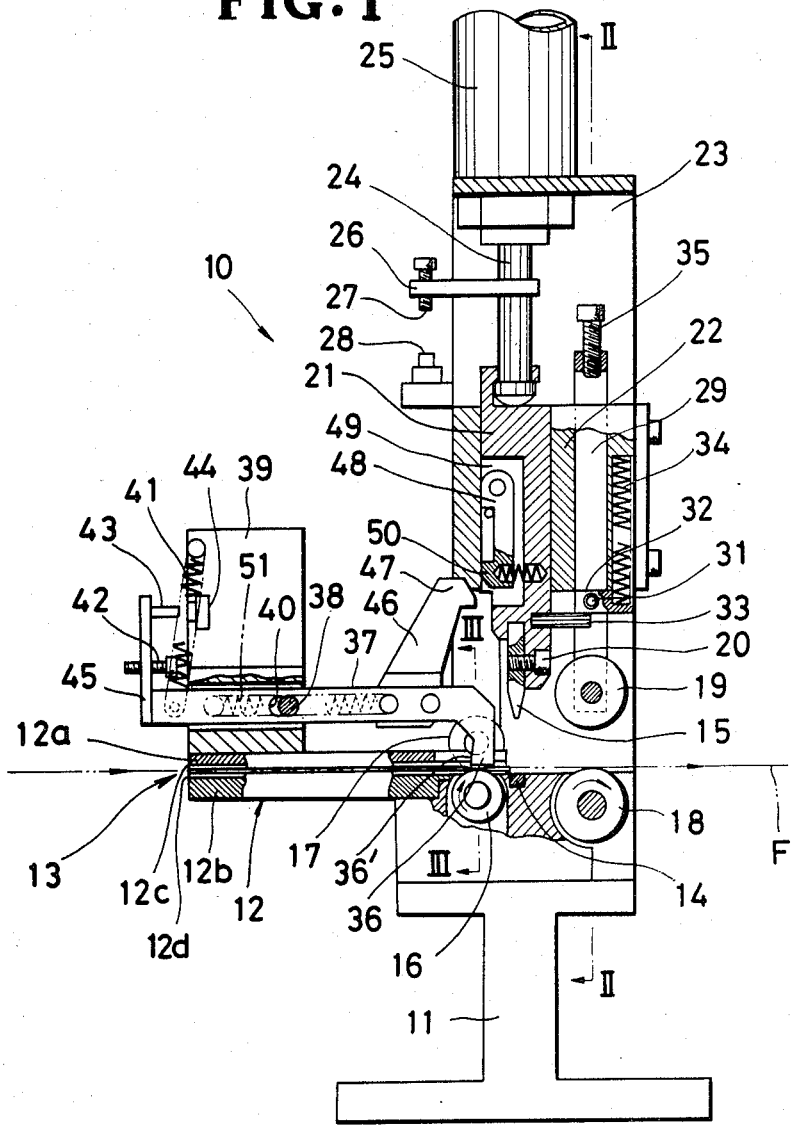
FIG. 1 is a side elevation, partly cross-sectional, of an apparatus embodying the invention.

As shown in FIG. 1, the apparatus 10 embodying the invention generally comprises a frame 11, a guide means 12 secured thereto and defining a longitudinally (horizontally) extending guideway 13 for guiding the fastener chain F to be cut, an anvil 14 secured to the frame 11 at the rearward end of the guide means 12, a cutting punch 15 vertically movable and cooperative with the anvil 14 to cut the fastener chain F in a manner described below, a pair of vertically opposed feed rolls 16,17 arranged forwardly of the path of movement of the punch 15 to advance the chain F to be cut, and a pair of delivery rolls 18,19 arranged rearwardly of the path of movement of the punch to deliver the cut length of the chain F out of the apparatus 10.

More specifically, the cutting punch 15 is secured by bolt 20 to a punch holder 21 which is movably mounted in a casing 22 integrally formed with an upright frame member 23. The punch holder 21 is moved vertically by a piston rod 24 which is in turn actuated by a cylinder 25. The cutting punch 15 may be sharply edged as shown, or dull headed. A horizontal arm 26 is connected at one of its ends to the piston rod 24 and provided at the other end with an adjusting screw 27 which is engageable with a microswitch-energized sensor 28.

Figure 2:
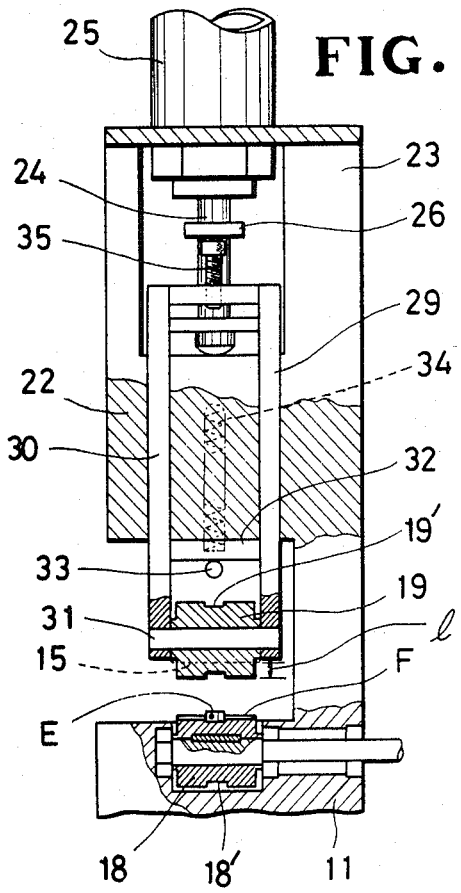
FIG. 2 is a cross-sectional view taken along line II—II of FIG. 1.

Engagement of the screw 27 with the senser 28 changes the direction of drive of the cylinder 25 and simultaneously actuates the drive feed roll 16 upon a lapse of a predetermined length of time. A pair of oppositely spaced vertical support bars 29,30 (FIG. 2) is movably mounted in the casing 22 in parallel relation to the punch holder 21. The bars 29,30 are interconnected near their lower ends by a pin 31 on which the delivery pressure roll 19 is rotatably mounted. A horizontal support member 32 is fixedly connected between the support bars 29,30 above the pressure roll 19. The support member 32 is engageable with a pin member 33 extending horizontally from the punch holder 21 adjacent to the punch 15. With descending movement of the punch holder 21, the support bars 29,30 descend under their own weight in response to gravity together with the pressure roll 19. To assure this self descending of the bars 29,30, it is preferable to provide a compression spring 34 to bias the support member 32 positively downwardly. The bars 29,30 descend until the pressure roll 19 comes into abutting engagement with the mating delivery roll 18, gripping therebetween the length of the fastener chain F that has been cut apart. To avoid the application of excessive pressure of the bars 29,30 and the pressure roll 19 onto the fastener chain F, there is provided an adjusting screw 35 in confronting relation to and engageable with the top surface of the casing 22 so that the screw 35 can control the extent of the descending stroke of the bars 29,30, and hence the pressure roll 19. With the pressure delivery roll 19 and the cutting punch 15 both held in their respective uppermost positions, the lower end surface of the roll 19 lies lower by distance l than the tip or lower end surface of the punch 15 as better shown in FIGS. 2 and 5. The delivery rolls 18 and 19 are provided centrally with peripheral grooves 18' and 19' respectively which are in registry and which are dimensioned to receive the coupled rows of fastener elements E of the chain F, as better shown in FIGS. 2 and 4, for purposes well known.

Figure 3:
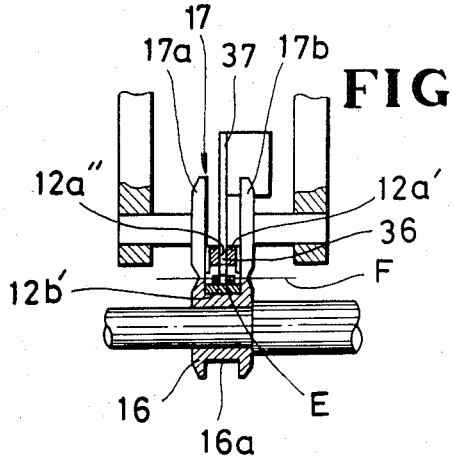
FIG. 3 is a fragmentary cross-sectional view taken along line III—III of FIG. 1.
Figure 4:
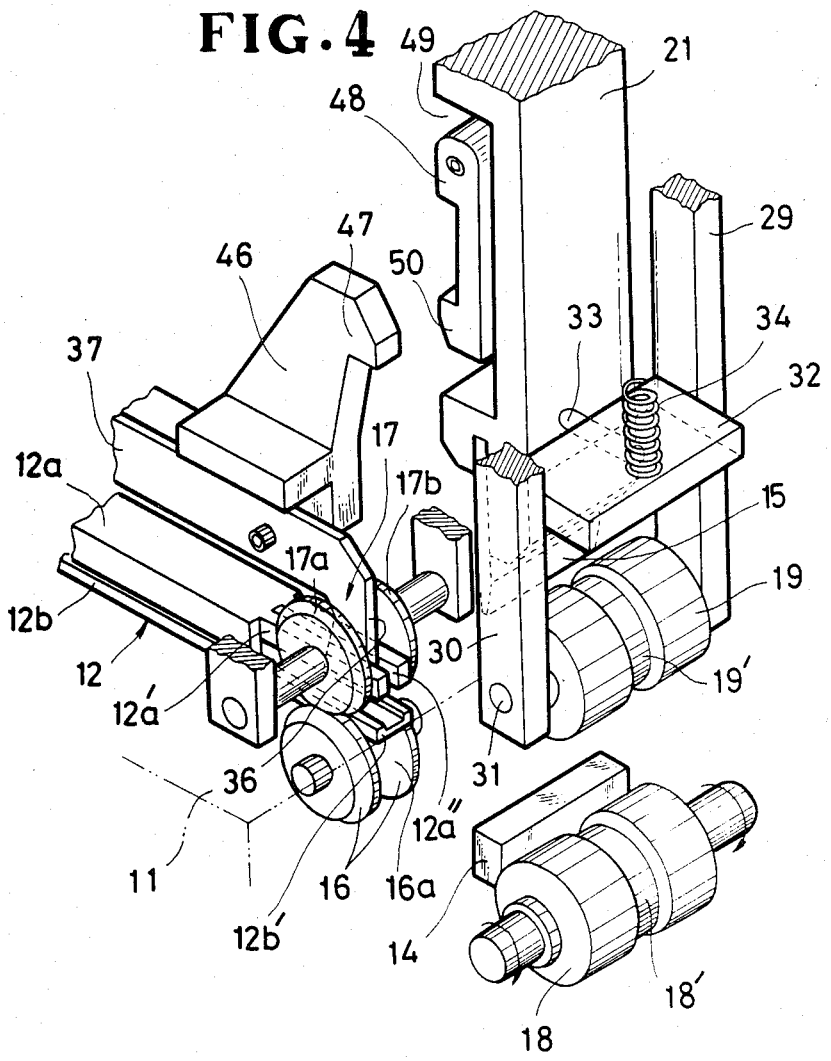
FIG. 4 is a fragmentary perspective view of the primary parts of the apparatus.

The guide means 12 referred to above comprises an upper guide plate **12*a* and a lower guide plate 12*b* which are spaced apart to permit the passage of the fastener tapes T and are provided centrally with longitudinal grooves 12*c* and 12*d* dimensioned to receive the coupled rows of fastener elements E during travel thereof along the guideway 13. As shown in FIGS. 3 and 4, the upper feed roll 17, which is disposed for abutting engagement with the upper face of the fastener tapes T, comprises of a pair of identical idler rolls 17*a* and 17*b* which are spaced apart in opposition by a distance large enough to receive therebetween a narrowed extension 12*a'* of the upper guide plate 12*a*. This extension 12*a'* is bifurcated to form a cut-out groove 12*a''* for the reception therein of a control prong 36 described below. The lower feed roll 16, which is normally driven clockwise by a source not shown, is provided centrally with an annular peripheral groove 16*a* having a width substantially equal to the spacing between the pair of opposed upper rolls 17*a*,17*b* and so dimensioned as to receive a narrowed extension 12*b'* of the lower guide plate 12*b*. The lower and upper feed rolls 16,17** are arranged so as to engage the fastener tapes T adjacent to the rows of elements E of the fastener chain F.

The control prong 36 is integral with and extends downwardly from the forward end of a control lever member 37 which is pivotally connected by a pin 38 to an upright support 39 extending from the guide means 12 as shown in FIG. 1. The pin 38 is journalled in a longitudinally elongated aperture 40 so that the lever member 37 is allowed to move relatively to the upright support 39. A a tension spring 41 acts between the rearward end of the control lever member 37 and the upright support 39 and normally biases the lever 37 in the clockwise direction about the pin 38, as viewed in the drawings, so that the control prong 36 is urged to plunge through the cutout groove **12*a''* of the upper guide plate 12*a* and further into the guide groove 12*d* of the lower guide plate 12*b*. During advancing movement of the fastener chain F, therefore, the control prong 36 is pressed against the rows of fastener elements E until the arrival of an element-free gap or space S of the chain F, and then it tilts to engage in the space S between the opposed tapes T, and thereafter it comes into abutting engagement with the rearward end of the space S defined by the terminal element E' (FIG. 8) of the row of elements E. At this point, the control prong 36 is pulled by advancing chain F to move longitudinally a limited distance defined by the length of the elongated aperture 40. Arrangements must be made so as to ensure that the fastener chain discontinues its travel immediately when the rearward end of the aperture 40 reaches the pin 38. Such arrangements are implemented by a control mechanism which comprises a stopper 42 and a contact strip 43 which is engageable with a microswitch sensor 44, the stopper 42 and the contact strip 43 being both secured to a support member 45 extending uprightly from the rear end of the lever 37, and the sensor 44 being mounted on the upright support 39. Immediately upon arrival of the control prong 36 at the rearward end of the space S of the fastener chain F, the contact strip 43 hits the microswitch 44 which in turn sends a signal to stop the rotation of the drive feed roll 16 and at the same time, to start descending movement of the punch 15**. Such control mechanisms are well known and hence will require no further description.

In order to lift the control prong 36 to bring it up again onto the rows of fastener elements E after the fastener chain F has been cut, there is provided an arm member 46 having a locking prong 47 extending upwardly from the lever 37 adjacent to the control prong 36, which arm member 46 is adapted to releasably engage a hook member 48 accommodated in a recess 49 in the punch holder 21. The hook member 48 has a hook end 50 complementary in shape to that of the locking prong 47 and is spring-biased so that the hook member 48 during descending movement can resiliently retract in contact with the arm member 46 via the prong 47 and the hook 50. As the hook member 48 ascends with the punch holder 21, it hooks and lifts the arm 46 until the lever 37 assumes its position substantially in parallel with the guideway 13, i.e. the line of passage of the fastener chain F. At this point, the lever 37 is retracted toward the left as viewed in the drawings by means of a tension spring 51 acting between the lever 37 and the upright support 39, thereby releasing the arm member 46 from the hook member 48. The control prong 36 then is urged downwardly by the spring 41 to ride again on the rows of elements E of the fastener chain F. In this position, the rear wall surface 36' of the control prong 36 lies importantly behind the point of contact between the feed rolls 16 and 17.

Figure 5:
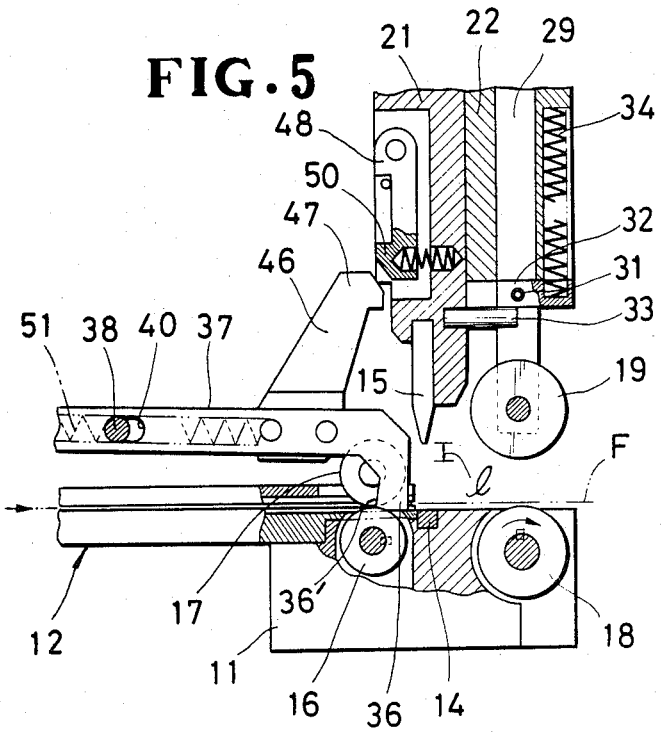
FIGS. 5 through 7 inclusive are side elevational, partly cross-sectional views illustrating the apparatus in the sequential cutting operation.
Figure 6:
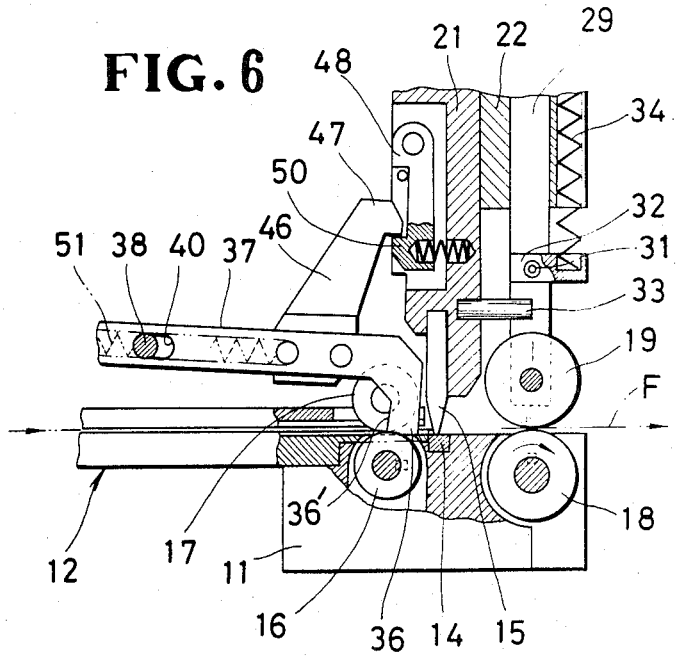
Figure 7:
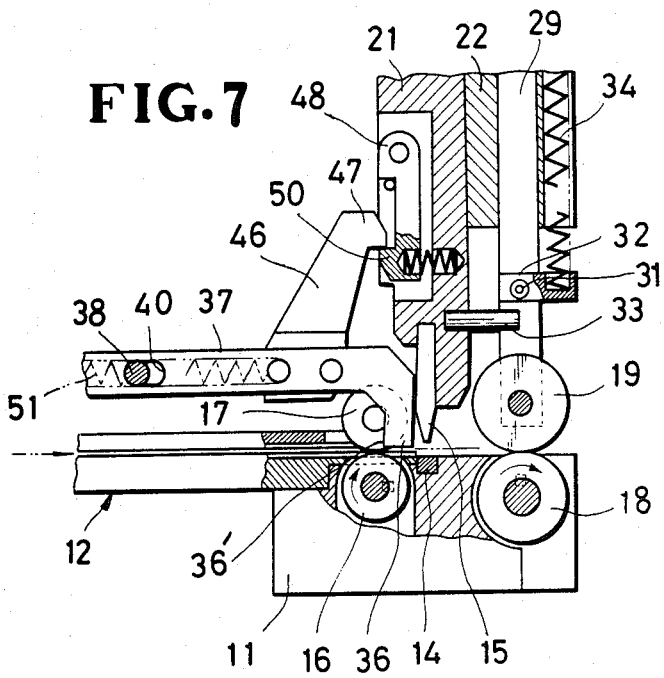

The operation of the apparatus 10 thus constructed is described with reference to FIGS. 5, 6 and 7. The cycle of operation begins with the engagement of the control prong 36 in the element-free space S of the fastener chain F, whereupon the feeding movement of the chain F is discontinued to position its prospective cut-line C in registry with the path of the cutting punch 15 as shown in FIG. 5. The punch 15 now descends with the pressure delivery roll 19 until the latter engages the drive delivery roll 18 which is in rotation. This coaction will momentarily give tension to the fastener chain F at its space portion S so that this portion is held taut to ensure straight and sharp cutting exactly at right angles to the length of the chain F along prospective cut-line C. This cutting is effected, as shown in FIG. 6, by the punch 15 which engages after the roll 19 has reached the point of contact with the chain F. The length of fastener chain F thus cut is withdrawn by the delivery rolls 18,19 out of the apparatus 10. This step is followed by the ascending of the punch 15 which takes place in advance of the ascent of the roll 19. As the punch 15 ascends, the arm member 46 is lifted in engagement with the hook member 48 until the lever 37 lies substantially in parallel with the horizontal path of the fastener chain F and hence the control prong 36 is disengaged from the space S, as shown in FIG. 7. The lever 37 is then retracted by the extension spring 51 to bring the control prong 36 up again on the rows of elements E, in which position the rear wall surface 36' is arranged to lie behind the point of contact of the feed rolls 16,17, so that the prong 36 holds the chain F flat against buckling, thereby ensuring normal chain travel. Since the upper delivery roll 19 ascends following the punch 15 and is kept clear out of the path of the ensuring fastener chain F to be cut, the latter is allowed to proceed without interference even if it is curled up. Where the fastener tapes T are made of thermoplastic fibers, the head of the punch 15 may be flattened so that when it co-acts with the anvil 14, the tapes T thereby cut undergo crystallization so that the resulting cuts may be clean without burrs.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for cutting a continuous intermittently gapped slide fastener chain into individual fastener lengths, comprising:

(a) a frame having a guideway for longitudinal movement of the chain;

(b) a pair of feed rolls disposed at the discharge end of said guideway for engaging opposite sides of the chain, and adapted to be intermittently driven;

(c) an anvil on said frame downstream of said feed rolls;

(d) a vertically reciprocable cutting punch assembly slidably supported on said frame in registration with said anvil;

(e) a pair of vertically opposed delivery rolls disposed downstream of said anvil for acting on opposite sides of a severed portion of the chain, said rolls being normally spaced apart to enable said feed rolls to drive any curled end of the advancing chain therebetween;

(f) means supporting one of said delivery rolls on said cutting punch assembly for vertical movement therewith toward the other of said delivery rolls, the latter being normally constantly rotating; and (g) control means responsive to the arrival of a gap in the chain for sequentially stopping said feed rolls, and lowering said one delivery roll and said punch assembly to thereby effect the cutting and the driven discharge of the severed portion, said control means including:

a control lever having a control prong, and being pivotally biased to urge said control prong against the chain and into a succeeding gap in the chain, said control lever being also yieldably longitudinally biased to be longitudinally shifted by the succeeding slide fastener by a selected amount to effect proper registration of the gap with the cutting punch assembly.

2. An apparatus according to claim 1, said control lever having a locking prong fixed thereto, and said cutting punch assembly having a resiliently biased hook member engageable with said locking prong in response to advancing movement of said punch assembly, said hook member in response to retracting movement of said punch assembly acting on said locking prong to pivot said control member against its pivotal bias to raise said control prong from the gap, whereby said control lever is shifted in response to its longitudinal bias to place said control prong on the succeeding ungapped portion of the chain.

3. An apparatus according to claim 1, said control prong having a rear wall surface for engaging said succeeding slide fastener, said rear wall surface being normally disposed upstream from the point where said feed rolls engage the chain, whereby said control prong holds the chain flat just upstream of said feed rolls.

* * * * *